United States Patent [19]

Lattion

[11] 4,403,472

[45] Sep. 13, 1983

[54] METHOD OF CLEANING SPINNING ROTORS AND APPARATUS FOR CARRYING OUT THE METHOD

[75] Inventor: Andre Lattion, Seuzach, Switzerland

[73] Assignee: Rieter Machine Works Limited, Winterthur, Switzerland

[21] Appl. No.: 402,935

[22] Filed: Jul. 29, 1982

[30] Foreign Application Priority Data

Aug. 11, 1981 [CH] Switzerland ..... 5051/81
Jun. 11, 1982 [CH] Switzerland ..... 3631/82

[51] Int. Cl.[3] ..... D01H 7/885
[52] U.S. Cl. ..... 57/302; 57/304
[58] Field of Search ..... 57/300–302, 57/304, 411, 415

[56] References Cited

U.S. PATENT DOCUMENTS

| | | | |
|---|---|---|---|
| 3,895,483 | 7/1975 | Grau | 57/302 |
| 4,057,955 | 11/1977 | Roehrich | 57/302 |
| 4,058,963 | 11/1977 | Stahlecker | 57/302 |
| 4,069,654 | 1/1978 | Roehrich | 57/302 |
| 4,135,354 | 1/1979 | Stahlecker | 57/302 |
| 4,211,063 | 7/1980 | Bock et al. | 57/302 |
| 4,265,083 | 5/1981 | Braun et al. | 57/304 X |

*Primary Examiner*—John Petrakes
*Attorney, Agent, or Firm*—Werner W. Kleeman

[57] ABSTRACT

The invention concerns the pneumatic cleaning of spinning rotors for open-end spinning. Cleaning is accomplished in a manner such that the spinning rotor is brought to standstill and a cleaning device is snugly seated by means of its cleaning cover upon the rotor housing. Thereafter, during a suction operation there is particularly sucked away the part of the contaminants or impurities forming a fiber ring. Then, there is formed an air jet by means of pressurized or compressed air and a blower head which is introduced into the internal space of the rotor. This air jet while rotating frees the remaining contaminants or impurities, especially the dust-like contaminants, which are then likewise removed by suction.

In comparison to the presently known cleaning methods working with air it is possible, by virtue of the standstill of the spinning rotor and the provision of cleaning steps which are accommodated to the encountered types of contaminants or impurities, to realize an appreciably improved cleaning operation. In contrast to cleaning devices working with rotating brushes there is here eliminated the drawback of possibly scratching the inner surface of the spinning rotor. Additionally, there is prevented the shortcoming that fibers and yarn remnants tend to cling to cleaning brushes and thus clog the same, so that they more or less loose their desired cleaning action.

16 Claims, 3 Drawing Figures

METHOD OF CLEANING SPINNING ROTORS AND APPARATUS FOR CARRYING OUT THE METHOD

BACKGROUND OF THE INVENTION

The present invention relates to a new and improved method of, and apparatus for, cleaning spinning rotors.

In its more particular aspects the invention relates to an improved method of, and apparatus for, cleaning spinning rotors for open-end spinning, wherein each rotor is located in a respective rotor housing containing a rotor housing opening provided for external suction. The rotor housing of the rotor which is to be cleaned is opened and is covered by a cleaning apparatus or device mounted upon such rotor housing. The cleaning device generates at least one rotating air jet by means of a rotatable blower body or member, this rotating air jet essentially impinging a collecting groove of the rotor.

In German Pat. No. 2,613,180 there is disclosed an open-end spinning machine, wherein the means or facilities for cleaning the spinning rotor include a combined blowing and suction apparatus movable towards the spinning rotor. Additionally, the suction part possesses a flange which bears in the manner of a cover against the housing surrounding the spinning rotor. The cleaning operation occurs by alternately subjecting the spinning rotor to a blowing operation and a suction operation.

In U.S. Pat. No. 4,211,063 there is disclosed the use of two air jets which blow air at predetermined different angles against the collecting groove and the interior of the rotor which is in a state of rotation. According to the teachings of this patent the spinning rotors rotate during the cleaning operation. This means that the impurities or contaminants collected in the collecting groove of the rotor adhere quite firmly because of the action of the centrifugal force. Consequently, it is difficult to achieve a relatively faultless cleaning operation with this prior art cleaning apparatus.

In German Pat. No. 2,648,066 there is disclosed a method wherein, for the purpose of cleaning the rotor, a rotating cleaning brush extends into the rotating rotor and comes into contact with its inner surface, and, in particular, also with the collecting groove of such rotor.

In German Pat. No. 2,410,269 there is provided a flexible probe which constitutes a mechanical cleaning element intended to be introduced into the spinning rotor which is to be cleaned.

When brushes are used the relatively strong adherence of the impurities in the collecting groove of the rotor because of the action of the centrifugal force is of secondary significance. However, the danger exists that the inner wall or surface of the rotor will be scratched when using such solid-body or mechanical cleaning means. It should be here further mentioned that such danger also exists when there are used cleaning scrapers. As a result, there is impaired the uniformity of the fibers which are to be spun and collected in the collecting groove of the rotor. Also, fibers and yarn remnants can adhere to the cleaning brushes and wind around such cleaning brushes, so that their cleaning action is appreciably reduced. Additionally, when there are used cleaning brushes the wear thereof is relatively high.

SUMMARY OF THE INVENTION

Therefore, with the foregoing in mind it is a primary object of the present invention to provide a new and improved method of, and apparatus for, cleaning spinning rotors in a manner not afflicted with the aforementioned drawbacks and limitations of the prior art proposals.

Another and more specific object of the present invention is directed to a new and improved method of, and apparatus for, cleaning spinning rotors in an extremely reliable, efficient and protective manner.

Yet a further significant object of the present invention is directed to a new and improved method of, and apparatus for, cleaning spinning rotors for open-end spinning in an efficient, positive and reliable manner, safeguarding against scratching or otherwise marring the inner surface of the spinning rotor while effectively removing from the collecting groove thereof any contaminants or the like which have collected therein, and wherein, the cleaning operation itself does not adversely affect or impair the cleaning equipment used for carrying out the same.

Now in order to implement these and still further objects of the invention, which will become more readily apparent as the description proceeds, the inventive method of cleaning a spinning rotor contemplates, prior to producing the air jet, bringing the rotor to standstill. Together with the placement of the cleaning device upon the rotor housing there is formed between the end face of a blower head, defining the rotatable blower body, confronting the rotor and the free end of the rotor a circular or annular gap located between two essentially parallel planes, and through which annular gap air is sucked-in during a suction operation from the rotor housing opening through the internal space of the rotor. Thereafter, the blower or blowing head is moved into the internal space of the rotor and placed into rotation, and thus, forms the rotating air jet while the suction operation is maintained.

As already alluded to above, the invention is not only concerned with the aforementioned method aspects, but also relates to a new and improved construction of cleaning apparatus or device for the cleaning of spinning rotors. According to the invention the cleaning device for the performance of the inventive method comprises a cleaning cover which can be mounted upon the rotor housing of the rotor which is to be cleaned as well as the rotatable blower head, the axis of rotation of which essentially coincides with that of the spinning rotor. A suction channel is provided which extends through the cleaning cover. The blower head is movable parallel to its axis of rotation from its work position, where its end face confronting the rotor is located in the neighborhood of the free edge or rim of the rotor and forms together with such free edge or rim the circular or annular gap, into a second working position in which the blower immerses into the internal space of the rotor. The cleaning device contains at least one cleaning channel serving to generate an air jet. This cleaning channel is operatively connected with a pressure or compressed air line which serves for the selective infeed of pressurized air into the cleaning channel.

The thorough cleaning of the spinning rotor which can be attained when practicing the teachings of the invention can be essentially realized in that, apart from eliminating the already mentioned undesirable centrifugal force, the fiber-like contaminants or impurities collected in the collecting or collection groove of the rotor are carried away through the suction operation which is initiated at the start of the cleaning operation, and thereafter, the relatively strongly adhering contaminants or impurities composed of fine dust particles are blown away by an intensive, i.e. as short as possible air jet. In this way there is provided for both types of contaminants or impurities a cleaning operation which is most effective and specifically accommodated to that particular type of contaminant.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
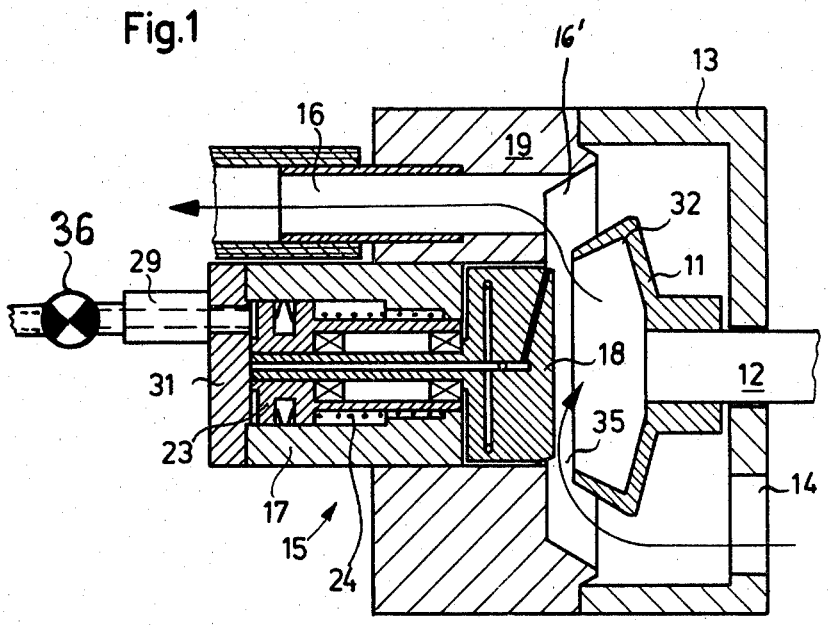
FIG. 1 is a longitudinal sectional view of a spinning rotor and a cleaning device, depicting the position of the blower head during the suction operation.

Turning attention now to the drawings, it is to be understood that only enough of the construction of the open-end spinning machine has been shown as will enable those skilled in the art to readily understand the underlying principles and concepts of the present development while simplifying the illustration of the drawings. Describing now FIGS. 1 and 2 in greater detail, there is depicted therein a spinning rotor 11 which is rotatably supported by a journal bearing 12. The spinning rotor 11 is located internally of a rotor housing 13. This rotor housing 13 is provided with a rotor housing opening 14 which, during normal operation of the spinning rotor 11, is designated to handle the external suction serving for the transport of the sliver or the like. During its use the rotor housing 13 is normally closed by a suitable cover.

However, this cover has not been particularly shown in the drawing in order to simplify the illustration, and in place thereof there has been depicted a cleaning device or apparatus 15 which is mounted upon the rotor housing 13. The cleaning device 15, as contemplated by the invention, comprises a suction line or conduit 16 defining a suction channel, a cylinder 17, a blower or blowing head 18, and a cleaning or cleaner cover 19. The suction line or channel 16 has an opening or mouth portion 16' opening into the rotor housing 13 at a location essentially diametrically opposite the rotor housing opening 14. The cleaning cover 19 can be placed with a snug fitting seat upon the open rotor housing 13. The blower or blowing head 18 is supported at one end of a shaft 21, and this shaft 21 is rotatably mounted in suitable anti-friction bearings or rotation bearing means 22. The axes of rotation of the rotatable spinning rotor 11 and the rotatable shaft 21 thus coincide with one another. The bearings 22 are carried by a piston member 23 which can be axially displaced to-and-fro within the cylinder 17. By means of a return or restoring spring 24 the piston member 23 is subjected to a biasing force towards the left-hand side of the showing of the drawings, i.e. to a biasing force which is directed towards the end face of the cylinder 17 facing away from the blower head 18.

A cleaning or cleaner channel 25 is provided in the blower head 18 for the purpose of generating an air jet. This channel 25 opens at one end into a lengthwise extending or longitudinal bore 26 provided in the rotatable shaft 21. Additionally, drive channels 27 are formed by air ducts, these drive channels 27 serving to place the blower head 18 into a state of rotation. The drive channels 27 extend from the longitudinal bore 26 in opposed directions radially towards the outside and bend essentially at right angles and in opposing directions relative to one another in close proximity to the outer cylindrical surface of the blower head 18. As best seen by referring to FIG. 3, these flexed or bent channel portions 27' of the drive channels 27 extend approximately tangentially to the surface of the blower head 18 at their exit or outlet locations from such blower head 18. The air effluxing from the drive channel portions 27' must possess at least one component of movement which is tangential to the surface of the blower head 18 in order to be able to place the blower head 18 into a rotational movement.

Figure 2:
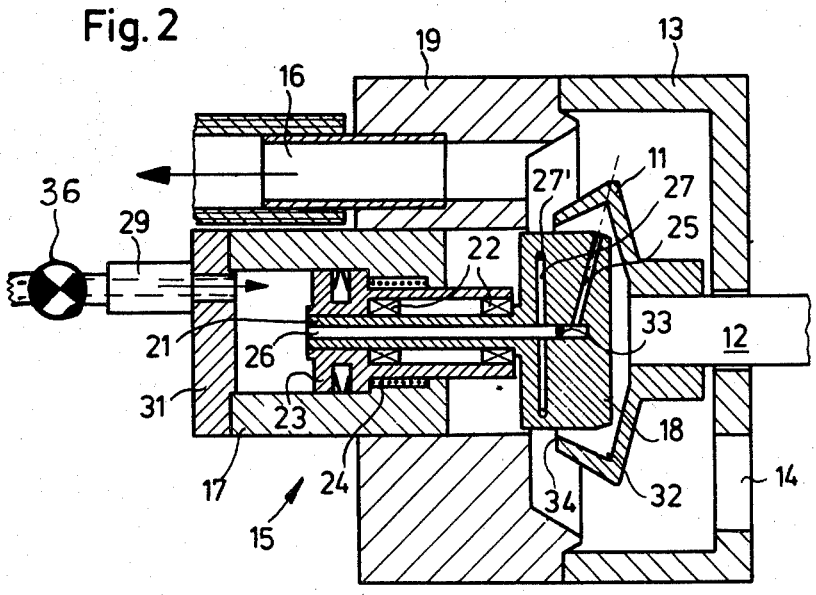
FIG. 2 is a longitudinal sectional view of the arrangement of FIG. 1, illustrating the position of the blower head during the blowing operation.
Figure 3:
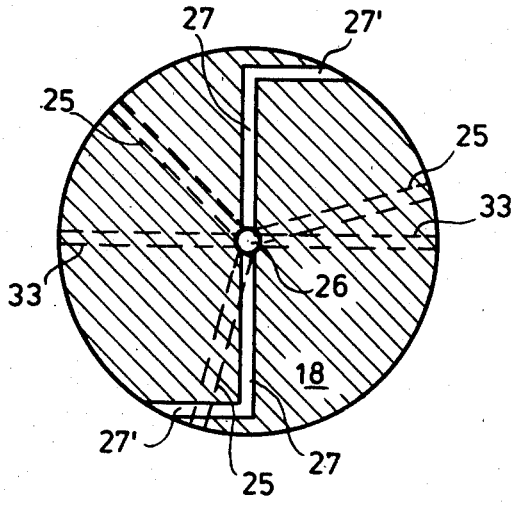
FIG. 3 is a cross-sectional view of the blower head depicting a further arrangement of the various air channels.

The cross-section of the blower head 18 shown in FIG. 3, in a plane perpendicular to its axis of rotation, and thus, also to the rotatable shaft 21, illustrates one possible arrangement of the channels. There are provided two drive channels 27 with the drive channel portions 27'. They extend in the manner already heretofore previously described. In contrast to FIG. 2, there is not provided a single cleaner or cleaning channel 25, but three cleaning channels 25. These three cleaning channels 25 are arranged at essentially the same angular spacing or equidistantly about the longitudinal bore 26. All of these cleaning channels 25 are directed essentially towards the collecting groove 32 of the spinning rotor 11 which is particularly prone to fouling or contamination by pieces of fiber and dust particles. If desired, there can be additionally provided cleaning or cleaner channels 33 formed as air ducts. These cleaning channels 33 serve to carry out a particularly intense cleaning of the free edge or rim 34 of the rotor 11 where fibers tend to relatively strongly adhere. For this purpose, the cleaner or cleaning channels 33 are directed towards the rim or free edge 34 of the rotor 11. At the end face or side of the cylinder 17 facing away from the blower head 18 there is arranged a pressure or compressed air line 29 which serves for the selective infeed of compressed air to the internal space or chamber of the cylinder 17.

For the purpose of cleaning the spinning rotor 11 such is initially brought to standstill, for instance by swinging away a not particularly illustrated drive means used for driving the spinning rotor and, if desired, by braking such spinning rotor, as is well known in this technology. Then a not particularly illustrated cover of the rotor housing 13, which covers such during the normal operation, is pivoted away or swung open. Thereafter, the cleaning or cleaner device 15 is brought to the vicinity of the rotor housing 13 and the cleaning cover 19 is applied against the rotor housing 13, seating upon such rotor housing 13 with a close fit and covering the same. At this stage of the cleaning operation the piston member or piston 23, which is biased by the return or restoring spring 24, is located in its withdrawn or retracted position depicted in FIG. 1. In this position the end face or side of the blower head 18 which confronts the rotor 11 forms in conjunction with the free edge or rim 34 of the rotor 11 a circular or annular gap 35 having a thickness or width of, for instance, several millimeters. This annular gap 35 is located between two essentially parallel planes, one of which planes is defined by the rotor edge 34 and the other plane is defined by the end face or side of the blower head 18 confronting the rotor 11.

Experience has shown that due to a suction pulse emanating from the suction line 16 of the cleaning device 15, air flows as indicated by the arrows from the rotor housing opening 14 through the rotor housing 13, then through the annular gap 35 between the rotor rim or free edge 34 and the blower head 18, thereafter through the internal or inner space of the rotor 11, and then flows away through the suction line or conduit 16 or the like. Since during this phase of the cleaning operation the rotor 11 is at standstill, this air primarily entrains those impurities or contaminants composed of fiber pieces lying in the form of a fiber ring in the collecting or collection groove 32 and which no longer adhere because of the action of centrifugal forces. Consequently, these impurities or contaminants are effectively and positively carried away through the annular or circular gap 25 and the suction line 16.

Thereafter, pressurized or compressed air is introduced through the compressed air line or conduit 29 into the internal space of the cylinder 17. On the one hand, this causes a pressure to be exerted upon the piston member 23 which opposes and is greater than the biasing force exerted by the return or restoring spring 24. Thus, the piston member 23 is moved to the right of the showing of the drawings. Consequently, the blower head 18 is entrained, so that such now immerses or enters into the internal space of the rotor 11, and hence assumes the position depicted in FIG. 2. At the same time compressed or pressurized air penetrates into the longitudinal or lengthwise bore 26 and upon flowing through the latter enters the cleaning channel or cleaning channels 25, as the case may be, and also enters the drive channels 27 containing the drive channel portions 27'. The air flowing through the drive channel arrangement or drive channel means 27, 27' places the blower member or head 18 into rotation and the air flowing through the channels or channel means 25 blows out the last remnants of the impurities or contaminants which remained in the spinning rotor 11 and the collecting groove 32. These contaminants are predominantly fine dust particles which adhere relatively tenaciously in such collecting or collection groove 32. In order to remove such type of contaminants there must be formed by the channels 25 a powerful and sharply defined air jet. These dust particles are also carried away through the suction line or duct 16.

According to a modified embodiment, the drive channels 27 with the channel portions 27' are shifted to such an extent towards the free end of the blower body 18, in FIG. 2 towards the right thereof, that such likewise exert a blowing action into the internal space of the rotor 11, especially at the region of the collecting groove 32 thereof, and thus, likewise contribute to the cleaning thereof. In this case, they beneficially serve both for the drive of the blower head 18 and also for cleaning the collecting groove 32, but also can contribute to the cleaning of the rotor rim or free edge 34.

The shorter the air jet that much sharper and defined does it become. For this reason the air exit or outlet locations of the cleaning channels 25 are located upon the outer surface or jacket of the blower head 18, which, in the illustrated exemplary embodiment, possesses an essentially circular cylindrical configuration. If the diameter of the jacket or outer surface of the blower head 18 is selected to be as large as possible, so that the intermediate space between it and the rotor edge or rim 34 is small, then it is possible in this manner to place the air outlet locations or points as close as practically possible to the parts of the rotor 11 which are to be cleaned, in particular to the collection or collecting groove 32.

An additional further improvement of the cleaning of the rotor 11 can be obtained if the rotating air jet is varied as to its intensity, especially if it is formed by a series of successive air pulses. According to an advantageous constructional embodiment there are produced three successive blowing pulses for cleaning of the rotor 11. Depending upon the processed material and the degree of contamination the duration of such blowing pulses, i.e. the duration of generating each of such pulses amounts to between 0.3 and 1.5 seconds, and the intervals between the blowing pulses amounts to between 0.2 and 0.4 seconds.

A pulsating air jet possesses a more intensified cleaning force or action than an air jet of the same magnitude but constant strength. In particular, a pulsating air jet, in the exemplary embodiment of cleaning device depicted in FIGS. 1 and 2, additionally causes a to-and-fro movement of the piston member 23 in the cylinder 17, and thus, alters the immersion depth of the blower head 18 into the rotor 11. This change in the immersion depth causes, in addition to the action of the pulsating air jet, a still further improvement in the cleaning action, so that in the exemplary embodiment of FIGS. 1 and 2 the pulsating air jet is of particular advantage.

A pulsating air jet can be produced, for instance, by means of a controllable valve 36 which is incorporated into the air pressure line or conduit 29 and is opened and closed in accordance with the desired time intervals.

According to a further possible modification of the arrangement depicted in FIGS. 1 and 2, a bore is provided which leads from the atmosphere or surroundings to the chamber containing the blower head 18. This bore is dimensioned so as to permit a steady inflow of air into the chamber under the action of the suction which is applied by means of the line or duct 16. The air flow around the blower head 18 is therefore directed outwardly from the chamber, and this, in turn, reduces the tendency for dirt to be drawn from the rotor 11 into the chamber during the blower head movements.

While there are shown and described present preferred embodiments of the invention, it is to be distinctly understood that the invention is not limited thereto, but may be otherwise variously embodied and practiced within the scope of the following claims. Accordingly,

What I claim is:

1. A method of cleaning spinning rotors for open-end spinning, wherein a rotor is located in a related rotor housing provided with a rotor housing opening for application of external suction, comprising the steps of:

opening the rotor housing of the rotor which is to be cleaned;

mounting a cleaning device containing a rotatable blower head upon said rotor housing in order to cover the opened rotor housing;

during mounting of the cleaning device upon the rotor housing forming between an end face of the rotatable blower head and a free edge of the rotor an annular gap located between substantially parallel planes;

bringing the rotor to standstill prior to generating at least one rotatable air jet by means of the rotatable blower head of the cleaning device and which air jet essentially impinges a collecting groove of the rotor;

sucking air from the rotor housing through the internal space of the rotor during a suction operation; and thereafter immersing the rotatable blower head into the internal space of the rotor and placing such rotatable blower head into rotation, to thereby form the rotating air jet while maintaining the suction operation.

2. The method as defined in claim 1, further including the steps of:

impinging further locations of the rotor which require a particularly intensive cleaning by an air jet.

3. The method as defined in claim 1, further including the step of:

varying the strength of the rotating air jet.

4. The method as defined in claim 3, further including the steps of:

forming the rotating air jet by a series of air pulses.

5. The method as defined in claim 4, further including the steps of:

forming the rotating air jet by three air pulses which are produced during respective time periods lasting from approximately 0.3 to 1.5 seconds; and providing time intervals between said time periods of forming the air jets which amount to approximately 0.2 to 0.4 seconds.

6. The method as defined in claim 1, wherein:

the rotor is brought to standstill prior to mounting the cleaning device upon the rotor housing.

7. A cleaning device for cleaning spinning rotors for open-end spinning, comprising:

a cleaning cover which can be placed upon a rotor housing of a rotor having an axis of rotation and which rotor is to be cleaned;

said cleaning device containing a rotatable blower head having an axis of rotation;

said axis of rotation of the rotatable blower head substantially coinciding with the axis of rotation of the rotor;

a suction channel leading through said cleaning cover;

means mounting said blower head to be movable essentially parallel to its axis of rotation from a first working position, where an end face thereof is directed towards the rotor and forms with a free edge of the rotor a substantially annular gap, into a second working position where the blower head extends into the internal space of the rotor;

said blower head being provided with at least one cleaning channel serving for the generation of an air jet;

means providing a compressed air line serving for the selective infeed of compressed air to said cleaning channel; and said cleaning channel being operatively connected in flow communication with said compressed air line.

8. The cleaning device as defined in claim 7, wherein:

said mounting means for said blower head comprises:

a cylinder having a longitudinal direction of extent;

a rotatable shaft arranged substantially coaxially with respect to said cylinder;

rotation bearing means for supporting said rotatable shaft;

a piston displaceably arranged internally of said cylinder and movably supporting said rotatable shaft; and said piston being movable in the longitudinal direction of said cylinder;

said blower head being mounted at one end of said rotatable shaft; and said blower head being movable into the internal space of the rotor from a position where it forms said annular gap with said free edge of the rotor.

9. The cleaning device as defined in claim 8, wherein:

said cylinder contains an internal space;

said shaft contains a substantially central longitudinal bore opening at an end thereof directed towards said blower head into said internal space of said cylinder;

said compressed air line leading into the internal space of the cylinder at an end face of said cylinder facing away from said blower head; and said cleaning channel opening at one end thereof into said longitudinal bore.

10. The cleaning device as defined in claim 9, further including:

means for elastically biasing said piston towards an end face of said cylinder which is directed away from the blower head; and said compressed air line delivering compressed air to the piston at a pressure which is greater than the biasing force exerted upon said piston.

11. The cleaning device as defined in claim 10, further including:

a regulatable valve for regulating air flowing through the compressed air line.

12. The cleaning device as defined in claim 9, wherein:

said blower head contains at least one drive channel structured as an air channel for imparting a rotational movement to said blower head;

said drive channel flow communicating with said longitudinal bore; and air departing from the drive channel or at least a component of movement of said departing air being directed essentially tangentially with respect to a circular path described by the rotational movement of a point where the air departs from the drive channel.

13. The cleaning device as defined in claim 12, wherein:

an air stream flowing through the drive channel, upon exit from the blower head, is directed against a predetermined location to be cleaned.

14. The cleaning device as defined in claim 13, wherein:

said predetermined location to be cleaned is defined by a collecting groove of the rotor.

15. The cleaning device as defined in claim 7, wherein:

said suction channel has a mouth portion opening into said rotor housing; and said mouth portion of said suction channel and said rotor housing opening being arranged essentially diametrically opposite one another relative to said rotor.

16. The cleaning device as defined in claim 7, wherein:

said cleaning channel has an outlet location disposed at an external surface of the blower head at a point situated relatively close to a collecting groove at the rotor when the blower head is inserted into the internal space of said rotor.

* * * * *